US006762659B2

(12) United States Patent
Son et al.

(10) Patent No.: US 6,762,659 B2
(45) Date of Patent: Jul. 13, 2004

(54) RADIO FILTER OF COMBLINE STRUCTURE WITH CAPACITOR COMPENSATION CIRCUIT

(75) Inventors: Mi-Hyun Son, Suwon-shi (KR); Yong-Jun Kim, Songnam-shi (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/825,930

(22) Filed: Apr. 5, 2001

(65) Prior Publication Data

US 2001/0030588 A1 Oct. 18, 2001

(30) Foreign Application Priority Data

Apr. 6, 2000 (KR) ..... 2000-18036

(51) Int. Cl.[7] ..... H01P 1/20
(52) U.S. Cl. ..... 333/203; 333/205
(58) Field of Search ..... 333/203, 204, 333/205, 219

(56) References Cited

U.S. PATENT DOCUMENTS

| | | | | |
|---|---|---|---|---|
| 4,129,842 A | | 12/1978 | Torii et al. | |
| 4,157,517 A | | 6/1979 | Kneisel et al. | |
| 4,578,656 A | * | 3/1986 | Lacour et al. | 333/204 |
| 4,721,931 A | * | 1/1988 | Nishikawa et al. | 333/203 |
| 4,963,843 A | | 10/1990 | Peckham | 333/203 |
| 5,057,803 A | * | 10/1991 | Ooi et al. | 333/204 |
| 5,136,269 A | * | 8/1992 | Seitzer et al. | 333/204 |
| 5,525,954 A | * | 6/1996 | Komazaki et al. | 333/219 |

FOREIGN PATENT DOCUMENTS

| | | | |
|---|---|---|---|
| DE | 4135435 A1 | * | 4/1993 |
| FR | 2714216 A1 | * | 6/1995 |
| GB | 2 246 670 A | | 2/1992 |
| JP | 62140501 A | * | 6/1987 |
| JP | 63119302 A | * | 5/1988 |
| JP | 05275903 A | * | 10/1993 |
| JP | 10-190306 | | 7/1998 |
| JP | 10-190309 | | 7/1998 |

OTHER PUBLICATIONS

Patent Abstracts of Japan, vol. 011, No. 367 (E–561), Nov. 28, 1987 & JP 62 140501 A (NEC Corp), Jun. 24, 1987.

* cited by examiner

*Primary Examiner*—Benny T. Lee
*Assistant Examiner*—Kimberly Glenn
(74) *Attorney, Agent, or Firm*—Sughrue Mion, PLLC

(57) ABSTRACT

A radio-filter of combline structure with a capacitor compensation circuit, having a transmission line filter with at least one pair of transmission lines arranged between input and output terminals for filtering the input signals through the input terminal to select signals of a given frequency band delivered to the output terminal, each of the transmission lines having a via-hole at each of its ends, a capacitor compensator of lumped element connected through one of the via-holes to one of the transmission lines for providing capacitance between the transmission line and ground, and a ground layer connected to the other via-hole not connected with the transmission line to ground the transmission line.

2 Claims, 3 Drawing Sheets

RADIO FILTER OF COMBLINE STRUCTURE WITH CAPACITOR COMPENSATION CIRCUIT

BACKGROUND OF THE INVENTION

1. Field of the Invention

The present invention relates to a radio filter employing transmission lines, and more particularly a radio filter of combline structure with a capacitor compensation circuit connecting multiple filter layers through via-holes.

2. Description of the Related Art

It is generally desired to manufacture a portable radio communications system, like a mobile phone, being of small size and low cost. Of course, this applies to other kinds of equipment and therefore development of various technologies is required.

In order to reduce the size of the portable radio communications system having a radio filter for receiving or transmitting signals of a desired frequency band only, while blocking other noise signals, transmission lines (stripline or micro stripline) are used which occupy much less space than passive elements.

Such a strip-line filter is disclosed in U.S. Pat. No. 4,963,843 granted to Motorola on Oct. 16, 1990, in reference to which the conventional combline stripline filter is briefly described as follows:

The conventional combline stripline filter comprises a substrate having top and bottom surfaces each with a conductive material thereon forming a respective ground plane. The substrate also has an inner circuitry layer, which includes a ground area consisting of a conductive material having a plurality of angled edges, and coupled to at least one of the ground planes, and at least two combline resonators. Each resonator comprises a strip of conductive material. The strips are substantially parallel to one another. Each strip has adjacent first ends coupled to at least one of the ground planes, and adjacent second ends capacitively coupled to the ground area. Each of the adjacent second ends further has at least one angled edge disposed opposite a corresponding angled edge of the ground area. Each strip further has a respective extension portion at the second ends disposed substantially at right angles to the parallel strips. Each extension portion has a respective edge disposed opposite and capacitively coupled to the ground area. One of the extension portions is coupled to the radio signal.

However, such a conventional stripline filter employing the pattern capacitor as described above suffers from increased layout size and increased error of the pattern capacitor caused by electrical interference. In addition, it is hard to connect with other devices, and its capacitance cannot be accurately measured because of its being capacitively coupled to ground.

Furthermore, its manufacture is complicated because the type of material used for the substrate determines the capacitance with respect to the ground area. Moreover, since the connections with the input pads, output pads, and ground are made at the ends of the substrate, the sizes and positions of other devices connected thereto are very limited.

SUMMARY OF THE INVENTION

It is an object of the present invention to provide a radio filter of combline structure with a capacitor compensation circuit connecting multiple layers through via-holes.

It is another object of the present invention to provide a radio filter of combline structure with a capacitor compensation circuit employing the capacitor of lumped element as the capacitor compensator.

It is still another object of the present invention to provide a radio filter of combline structure with a capacitor compensation circuit, which can be embodied on an ordinary substrate.

According to the present invention, a radio-filter of combline structure with a capacitor compensation circuit, comprises a transmission line filter having at least a pair of transmission lines arranged between input and output terminals for filtering the input signals through the input terminal to select signals of a given frequency band delivered to the output terminal. Each of the transmission lines has a via-hole at each of its ends, a capacitor compensator of lumped element connected through one of the via-holes to one of the transmission lines for providing capacitance between the transmission line and ground, and a ground layer connected to the other via-hole which is not connected to the transmission line in order to ground the transmission line.

The present invention will now be described more specifically with reference to the attached drawings which are shown for exemplary purposes only.

BRIEF DESCRIPTION OF THE ATTACHED DRAWINGS

DETAILED DESCRIPTION OF THE PREFERRED EMBODIMENT

Figure 1:
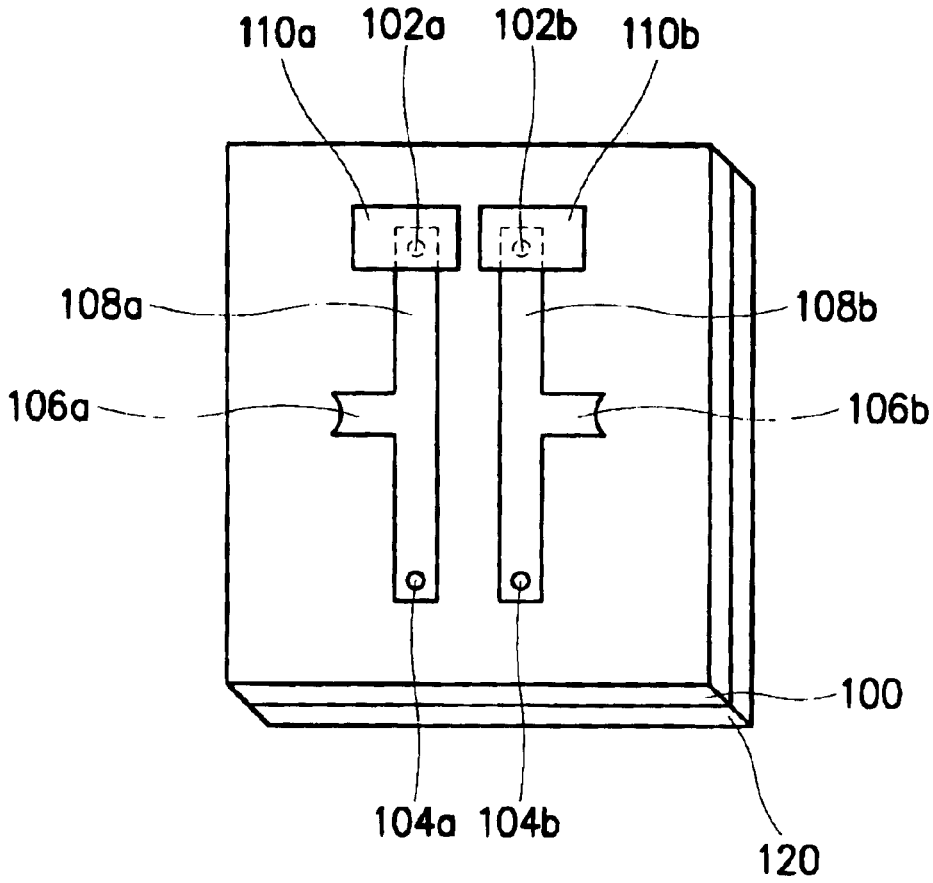
FIG. 1 is a schematic diagram illustrating the structure of a stripline filter according to an embodiment of the present invention.

Referring to FIG. 1, the inventive radio filter comprises a top filter layer 100 provided with a pair of micro striplines 108*a*, 108*b* forming the filter, and a bottom ground layer 120 supporting the top filter layer. Namely, the radio filter has the combline structure with the micro striplines 108*a* and 108*b* arranged on an ordinary copper clad laminate (CCL) substrate. The micro striplines 108*a* and 108*b* are coupled through via-holes 102*a*, 102*b*, 104*a*, and 104*b* to the bottom ground layer 120.

Namely, the micro striplines 108*a* and 108*b* are respectively coupled through the via-holes 102*a* and 102*b* to capacitor compensators 110*a* and 110*b* which are grounded, and also grounded through the via-holes 104*a* and 104*b* to the bottom ground layer 120. This is called a "blind via-hole arrangement".

Alternatively, the via-holes 102*a* and 102*b* are extended to the bottom ground layer 120 to connect with the capacitor compensators 110*a* and 110*b*, which is called "through via-hole arrangement".

In the present embodiment, the inventive radio filter is described in connection with the blind via-hole arrangement.

A first 108*a* of the pair of the micro striplines 108*a* and 108*b* constituting the radio filter is connected with the input terminal 106*a*, and the second 108*b* of the pair of the micro striplines is connected with the output terminal 106*b*. Each of the micro striplines 108*a* and 108*b* has via-holes 102*a* and 104*a* or 102*b* and 104*b* at respective ends. The via-holes

104*a* and 104*b* respectively connect the micro striplines 108*a* and 108*b* with the bottom ground layer 120, while the via-holes 102*a* and 102*b* respectively connect them with the capacitor compensators 110*a* and 110*b*.

The capacitor compensator 110*a*, 110*b* should have such a capacitance value that the length of the micro stripline 108*a*, 108*b* electrically meets the half wavelength of the center frequency of the radio filter. Thus capacitor compensators 110*a* and 110*b* reduce the length of the micro striplines 108*a* and 108*b*, and easily adjust the impedance matching and tuning. To this end, using a capacitor of lumped element, the capacitance is easily adjusted without adjusting the width or distance as in the conventional filter arrangement.

Although the capacitor compensators 110*a* and 110*b* are shown in FIG. 1 respectively arranged at the ends of the micro striplines 108*a* and 108*b*, each on the same side, their positions may be varied. The capacitances of the capacitor compensators 110*a* and 110*b* should be determined considering the capacitances of the via-holes 102*a* and 102*b*. Of course, the capacitances of the via-holes 102*a* and 102*b* vary from the blind via-hole arrangement to the through via-hole arrangement.

The radio filter thus obtained filters the input signals from the input terminal 106*a* to only select the signals of a given frequency band which are delivered to the output terminal 106*b*. In this case, the given frequency band is determined by the length of and the space between the micro striplines 108*a* and 108*b*, and the capacitances of the capacitor compensators 110*a* and 110*b* connected through the via-holes 102*a* and 102*b* to them. Further, additional via-holes may be provided in the input and output terminals 106*a* and 106*b* in order to connect other devices with the radio filter. For example, an additional via-hole in the input terminal 106*a* may be used for connecting with an antenna, with others in the output terminal 106*b* for connecting with another signal processing device.

Figure 2:
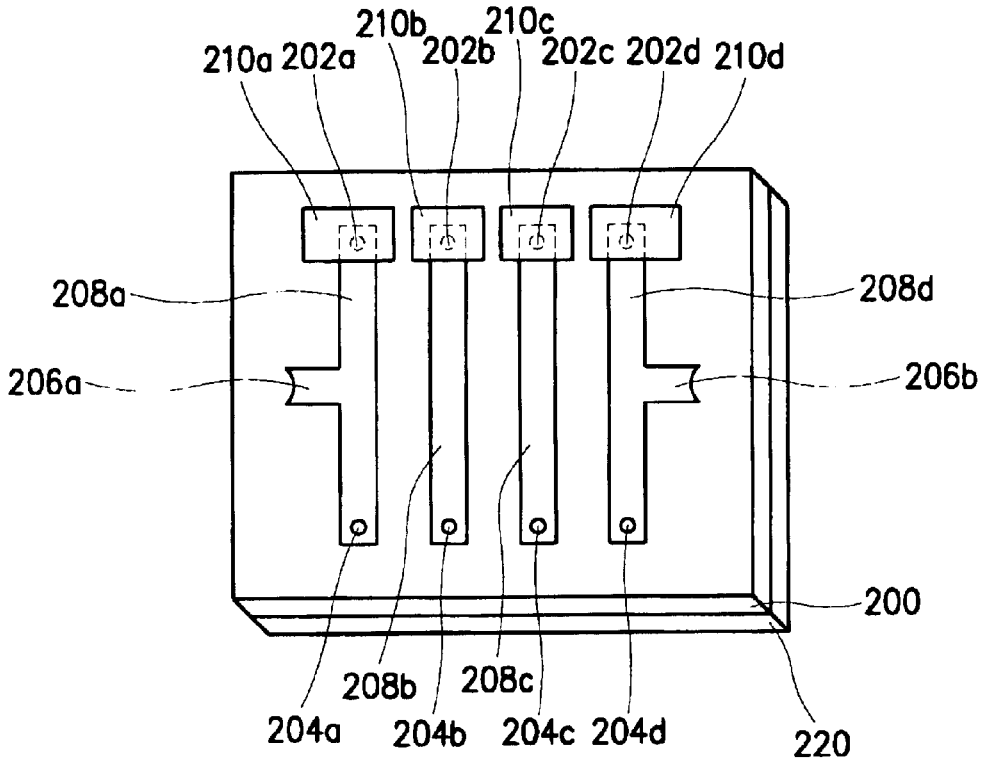
FIG. 2 is a view similar to FIG. 1 but with an additional pair of micro striplines arranged between the first pair of striplines of FIG. 1.

Referring to FIG. 2, a pair of additional micro striplines 208*b* and 208*c* are arranged between a pair of micro striplines 208*a* and 208*d* which are respectively connected with the input and output terminals 206*a* and 206*b*, as shown in FIG. 2. Of course, the number of the micro striplines arranged between the outer micro striplines 208*a* and 208*d* may be increased.

Figure 3:
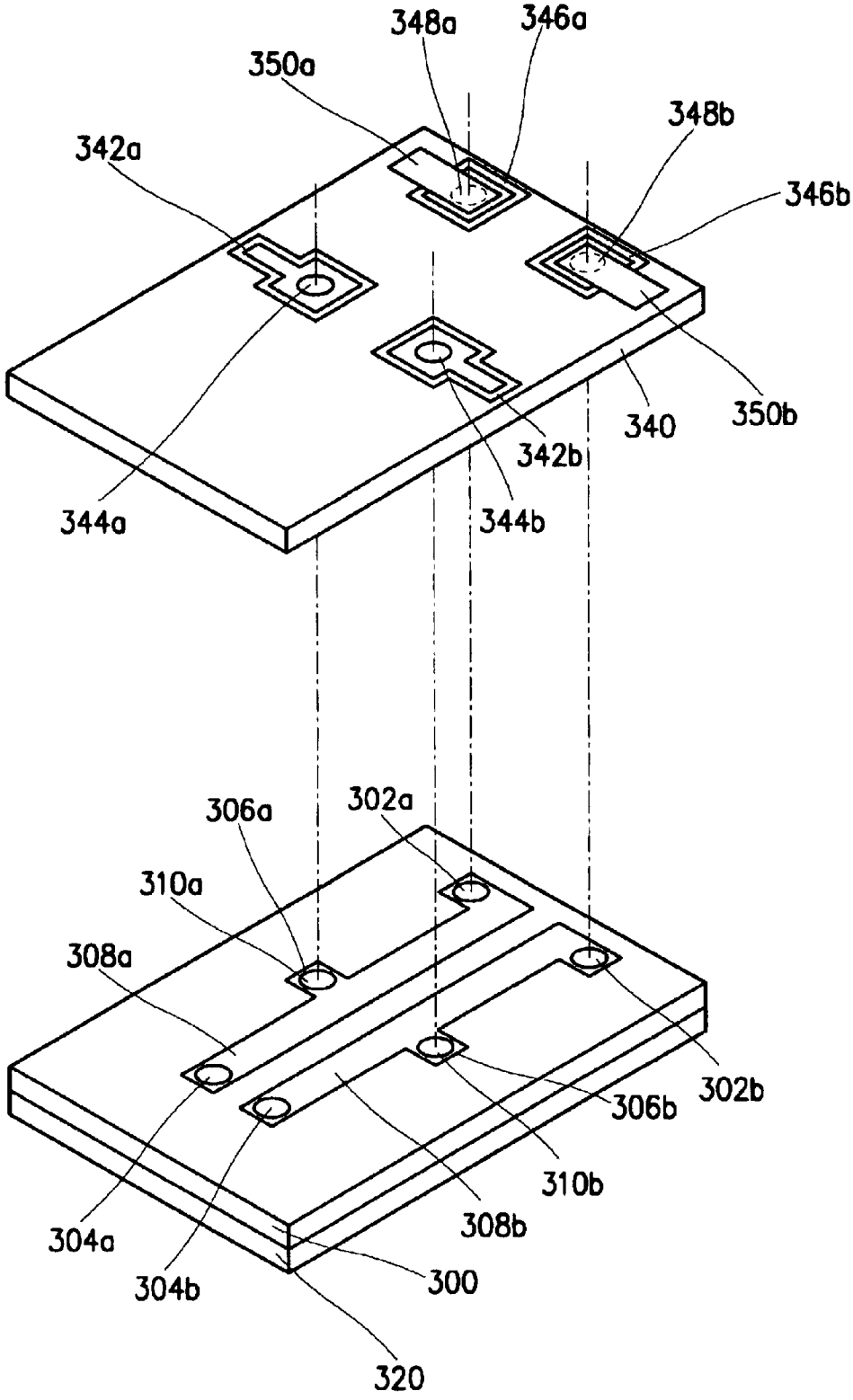
FIG. 3 is a partial exploded view for illustrating the inventive stripline filter arranged in an ordinary multi-layer substrate.

Referring to another embodiment shown in FIG. 3, the radio filter of multi-layer structure includes an additional layer 340 which is placed over the filter layer 300, as compared to the previous embodiment. Namely, the filter layer 300 containing a radio filter consisting of the striplines 308*a* and 308*b* is interposed between the top and bottom ground layers 320 and 340.

The filter layer 300 comprises an ordinary CCL substrate upon which the striplines 308*a* and 308*b* are arranged to construct the radio filter. In addition, the striplines 308*a* and 308*b* are respectively provided with a plurality of via-holes 302*a*, 304*a*, 310*a*, 302*b*, 304*b* and 310*b*. Thus, the striplines 308*a* and 308*b* are respectively connected through the via-holes 304*a* and 304*b* to the bottom ground layer 320, and through the via-holes 302*a*, 302*b*, 310*a*, 310*b* to the top ground layer 340.

Namely, striplines 308*a* and 308*b* are respectively connected through via-holes 302*a* and 302*b*, and via-holes 348*a* and 348*b* to the capacitor compensators 350*a* and 350*b* which are grounded, and through via-holes 310*a* and 310*b*, and via-holes 344*a* and 344*b* to the striplines 342*a* and 342*b*. This is the blind via-hole arrangement because the capacitor compensators 350*a* and 350*b* and striplines 342*a* and 342*b* are not connected through the via-holes to the bottom ground layer 320. Of course, they may be designed to connect through via-holes with the bottom ground layer by using the through via-hole arrangement.

Describing more specifically the radio filter thus obtained, one 308*a* of the pair of the micro striplines 308*a* and 308*b* constituting the radio filter is connected with the input terminal 306*a*, and the other 308*b* of the pair of the micro striplines is connected with the output terminal 306*b*. Each of the micro striplines 308*a* and 308*b* has via-holes 302*a* and 304*a* or 302*b* and 304*b* at respective ends.

The respective via-holes 310*a* and 310*b* of the input and output terminals 306*a* and 306*b* are respectively connected with the via-holes 344*a* and 344*b* of the top ground layer 340. The via-holes 304*a* and 304*b* connect the respective striplines 308*a* and 308*b* with the bottom ground layer 320, while the via-holes 302*a* and 302*b* respectively connect them through the via-holes 348*a* and 348*b* of the top ground layer 340 to the capacitor compensators 350*a* and 350*b*.

The top ground layer 340 is provided with a pair of closed loop striplines 342*a* and 342*b* enclosing a given area corresponding to the striplines 308*a* and 308*b* of the filter layer 300. The areas of the closed loop striplines 342*a* and 342*b* are respectively provided with via-holes 344*a* and 344*b* connected to the via-holes 310*a* and 310*b* of the input and output terminals 306*a* and 306*b* which are connected with striplines 308*a* and 308*b*. The striplines 342*a* and 342*b* serve the input and output terminals of the radio filter.

An additional pair of closed loop striplines 346*a* and 346*b* are provided in the top ground layer 340 to connect with the via-holes 302*a* and 302*b* formed at one-side ends of the striplines 308*a* and 308*b* of the filter layer 300. Namely, the areas enclosed by the closed loop striplines 346*a* and 346*b* are respectively provided with via-holes 348*a* and 348*b* connected to the via-holes 302*a* and 302*b*. In addition, the via-holes 302*a* and 302*b* are respectively connected with the capacitor compensators 350*a* and 350*b*.

The capacitor compensators 350*a* and 350*b* consist of capacitors of lumped element as described in the previous embodiment with capacitances proper for the frequency band filtered. Namely, the capacitor compensator 350*a*, 350*b* should have such a capacitance that the length of the micro stripline 308*a*, 308*b* electrically meets the half wavelength of the center frequency of the radio filter. The purpose of the capacitor compensators 350*a* and 350*b* is to reduce the length of the micro striplines 308*a* and 308*b*, and to easily adjust the impedance matching and tuning. To this end, using a capacitor of lumped element, the capacitance is easily adjusted without adjusting the width or distance as in the conventional filter arrangement. Although the capacitor compensators 350*a* and 350*b* are shown in FIG. 3 respectively arranged at the ends of the micro striplines 308*a* and 308*b* on the same side, they positions may be varied.

The capacitance values of the capacitor compensators 350*a* and 350*b* should be determined considering the capacitances of the via-holes 348*a* and 348*b*. Of course, the capacitances of the via-holes 308*a* and 308*b* vary from the blind via-hole arrangement to the through via-hole arrangement.

The radio filter thus obtained filters the input signals from the input stripline 342*a* through the via-holes 344*a* and 310*a* to the input terminal 306*a* to select the signals of a given frequency band only which is delivered to the output terminal 306*b*, which then transfers the signals through the via-hole 310*b* to the via-hole 344*b* of the top ground layer

340. In this case, the given frequency band is determined by the lengths of and the space between the striplines 308*a* and 308*b*, and the capacitance values of the capacitor compensators 348*a* and 348*b* connected through the via-holes 302*a*, 348*a* and 302*b*, 348*b* to them. Further, the striplines 342*a* and 342*b* provided in the top ground layer 340 may be used to connect other devices to the radio filter. For example, the stripline 342*a* may be used to connect an antenna, and the stripline 342*b* may be used to connect with another signal processing device.

Each layer of the inventive radio filter is composed of a CCL of epoxy resin, so that the conventional process may be used to construct the striplines. This facilitates the production of the radio filter with reduced cost.

Further, the capacitor compensates for the length of the stripline to electrically select the half wavelength of the center frequency of the radio filter. While the present invention has been described in connection with specific embodiments accompanied by the attached drawings, it will be readily appreciated that various changes and modifications may be made thereto without departing the gist of the present invention.

What is claimed is:

1. A radio-filter of combline structure with a capacitor compensation circuit, comprising:

a plurality of input terminals;

a plurality of output terminals;

a triple plate stripline filter having at least one pair of striplines arranged between first input and output terminals for filtering input signals through said first input terminal to select signals of a given frequency band for delivery to said first output terminal, each of said striplines having a via-hole at each of its respective ends, said first input and output terminals having via-holes;

a top ground layer having second input and output terminals formed of closed loop striplines containing via-holes connected respectively with the via-holes of said first input and output terminals of said stripline filter, and at least two capacitor compensators, respectively connected to a closed loop stripline connected to a via-hole connected with one of the via-holes of the striplines of said stripline filter to connect said respective capacitor compensator with one of the striplines of said stripline filter, wherein said at least two capacitor compensators are arranged at the same end of the respective striplines and each of said capacitor compensators is disposed on the respective stripline in a straight line with the via holes of the respective stripline; and a bottom ground layer connected to other via-holes of the stripline of said stripline filter which are not connected with said respective capacitor compensator, wherein said other via-holes ground said stripline.

2. A radio filter as defined in claim 1, wherein said respective capacitor compensator further comprises a lumped element adapted to provide capacitance enabling a length of said stripline to electrically meet a half wavelength of a center frequency of said triple plate stripline filter.

* * * * *